US008104459B2

(12) United States Patent
Young

(10) Patent No.: US 8,104,459 B2
(45) Date of Patent: Jan. 31, 2012

(54) THROWING SLING WITH MODIFIED BASKET, WEBBING AND CORD STRUCTURE

(76) Inventor: Alton Young, Novato, CA (US)

( * ) Notice: Subject to any disclaimer, the term of this patent is extended or adjusted under 35 U.S.C. 154(b) by 738 days.

(21) Appl. No.: 12/240,624

(22) Filed: Sep. 29, 2008

(65) Prior Publication Data

US 2010/0078003 A1 Apr. 1, 2010

(51) Int. Cl.
*F41B 3/04* (2006.01)

(52) U.S. Cl. ..... 124/5; 124/1; 124/4; 124/41.1; 273/129 R; 273/129 K; 473/505; 473/510

(58) Field of Classification Search ..... 124/1, 4, 124/5, 41.1; 273/129 K, 129 R; 473/505, 473/510

See application file for complete search history.

(56) References Cited

U.S. PATENT DOCUMENTS

| | | | | | |
|---|---|---|---|---|---|
| 1,199,330 | A | * | 9/1916 | Adams | 473/127 |
| 1,419,682 | A | * | 6/1922 | Miles | 124/5 |
| 1,776,435 | A | * | 9/1930 | Isbell | 124/5 |
| 2,311,160 | A | * | 2/1943 | Dobbelaar | 124/5 |
| 2,443,408 | A | * | 6/1948 | Walker | 124/20.1 |
| 2,644,441 | A | * | 7/1953 | Simko | 124/5 |
| 2,823,483 | A | * | 2/1958 | Malott | 43/19 |
| 4,034,981 | A | * | 7/1977 | Veneziano | 473/464 |
| 4,131,102 | A | * | 12/1978 | Polly, Jr. | 124/5 |
| 4,232,648 | A | * | 11/1980 | Brown | 124/5 |
| 4,240,396 | A | * | 12/1980 | Randoll | 124/17 |
| 4,305,584 | A | * | 12/1981 | Leehan | 473/127 |
| 4,922,884 | A | * | 5/1990 | Ford | 124/20.1 |
| 5,127,389 | A | * | 7/1992 | Magnuson | 124/17 |
| 5,190,021 | A | * | 3/1993 | Hull et al. | 124/20.1 |
| 5,277,169 | A | * | 1/1994 | Magnuson | 124/20.1 |
| 5,398,665 | A | * | 3/1995 | Carlson | 124/17 |
| 5,427,084 | A | * | 6/1995 | Arnold et al. | 124/5 |
| 5,579,750 | A | * | 12/1996 | Lease | 124/20.1 |
| 5,657,984 | A | * | 8/1997 | Leo | 124/20.1 |
| 5,887,577 | A | * | 3/1999 | Sherrill | 124/20.1 |
| 6,076,829 | A | * | 6/2000 | Oblack | 273/317 |
| 6,450,100 | B1 | * | 9/2002 | Carson | 102/513 |
| 6,595,160 | B1 | * | 7/2003 | Williamson | 119/702 |
| 7,032,583 | B1 | * | 4/2006 | Hall | 124/5 |
| 7,059,314 | B1 | * | 6/2006 | Teague | 124/20.3 |
| 7,461,645 | B2 | * | 12/2008 | Williamson et al. | 124/20.1 |
| 7,823,571 | B2 | * | 11/2010 | Williamson et al. | 124/20.1 |
| 7,861,700 | B2 | * | 1/2011 | Scoggins | 124/41.1 |

* cited by examiner

*Primary Examiner* — Gene Kim
*Assistant Examiner* — Alexander Niconovich
(74) *Attorney, Agent, or Firm* — Steven A. Nielsen; Allman & Nielsen, P.C.

(57) ABSTRACT

A sling like apparatus comprising a release cord, retention cord, finger loop, release tab, guide assembly, and basket creates a throwing device that is simple to reset, reload and throw while still retaining the power and accuracy of a traditional sling, thus making it user-friendly for anyone to quickly learn and operate. The retention cord comprises a comfortable finger loop that forks about half way in length into two cords that are each attached to specific and unique locations on the basket. The basket deforms into a form fitting structure that secures around a circular object or ball that may be roughly 2.5 inches or smaller in diameter. The release cord is attached to a particular location on the basket and is fed through a guide assembly. The end of the release cord connects to the release tab.

8 Claims, 4 Drawing Sheets

THROWING SLING WITH MODIFIED BASKET, WEBBING AND CORD STRUCTURE

CROSS-REFERENCE TO RELATED APPLICATIONS

Not applicable.

BACKGROUND OF THE INVENTION (1) Field of the Invention

The invention generally relates to sling devices for throwing objects. More particularly, the principles of the invention include unobvious modifications to a throwing sling structure and basket structure.

(2) Description of the Related Art

The basic sling may be traced to one of man's earliest inventions as a hunting tool or weapon. The oldest known slings to still be intact were found in the tomb of Tutankhamen. Many armies of antiquity wielded slings. Significant historical battles have been won due to advent of the sling. Historical military leaders such as Alexander the Great credited the sling for one of his incredible triumphs over the Persian army. The sling also has been mentioned in biblical accounts, most notably, the battle between David and Goliath. The account describes how David, a simple shepherd, defeats the champion warrior Goliath. When equipped properly, swung around in a circular motion then released at the right moment, the sling could propel its projectile farther and more accurate then even the famed long bows of the time.

The basic construction of a sling consists mainly of three parts. One, a cradle, pouch or basket that is constructed at the center of the sling, which would then fold around the projectile. Two, a retention cord, which forms into a finger loop. Three, a release cord, which would commonly have a knot at the end held by the user.

Revised concepts of the sling have been introduced during the modern ages, yet the basic principles have always stayed the same. The slings of today still use the same methods of construction and operation. In the related art, the sling is a device that has remained relatively unchanged since ancient time.

While the basic sling of the related art seems adequately designed, one of its main drawbacks is in the design of the basket, the component that holds the projectile or payload. A sling originally was created as a weapon or hunting tool to hurl stones, clay, lead or any other oval shaped object of similar size and mass. Such objects of such mass are inappropriate for modern recreational use, such as playing catch with a dog and waffle ball.

The related art has several shortcomings, for example, it would be difficult to take a sling of the related art that was designed to throw a rock and use it to throw a tennis ball. The tennis ball would have difficulty staying in the pouch and would expel itself before the user's release. Thus, to deal with modern payloads, unobvious and novel reconfigurations of the classic sling are now needed.

Though slinging with implements of the related art may accurately launch heavy pay loads, such implements require time to learn how to properly use. One of the clumsiest parts of operating a sling of the related art is to regain control of the release cord or release tab after one has launched the projectile. Regaining control of the release cord is necessary to reset the sling and to load the next projectile.

Another shortfall of slings in the related art is the need of a user to use one hand to hold the projectile in the basket while the other hand swings the sling. When enough momentum is reached with the sling, the basket holding hand may release the basket. Unfortunately, such slings of the related art often lead to beginners releasing the pouch too early and propelling the projectile in the wrong direction. Thus, there is a great need in the art for a new basket design that retains a projectile without assistance from the user.

DESCRIPTIONS OF RELATED PATENTS

U.S. Pat. No. 2,644,441 by A. S. Simko discloses a sling without means of retaining the release cord, without means of hands free retention of the payload, and without performance enhancing retention points upon the basket.

U.S. Pat. No. 4,232,648 by Brown fails to disclose means of controlling the release cord after launch, means of hands free retention of the payload, or unique points of attachment between the basket and sling cords.

U.S. Pat. No. 6,076,828 by Oblack presents means of hands free retention of a tennis ball of a predetermined size. But, the Oblack patent fails to disclose means of hands free retention of different sized objects. The basket of Oblack is rigid and ill adapted for non uniform projectiles.

U.S. Pat. No. 4,131,102 by Polly discloses the use of finger glove to help control a sling and the use of a basket hole to help retain a projectile. But, Polly fails to disclose flexible or adaptable means to retain non uniformed sized objects in a basket. Polly also fails to disclose means of retaining the release cord and fails to disclose unique attachment points in the basket that assist in performance.

BRIEF SUMMARY OF THE INVENTION

The principles of the present invention overcome shortfalls in the related art by providing unobvious features that provide unexpected results; such features include, but are not limited to:

1. Means of constructing a basket capable of hands free retention of a projectile. Unlike the related art, the principles of the disclosed invention provide means of retaining a projectile at the beginning stages of starting the swing of the sling.
2. Means of constructing a basket with attachment points that provide unexpected results in accuracy and velocity. The use of asymmetric attachment points between sections of the basket and the retention cord structure and the release cord provide an unexpected rolling or guiding force to the projectile during the release process.
3. Means of retrieving projectiles from the ground in a hands free manner. Fabric side sections and a lower web section of the disclosed basket provide unexpected means of scooping projectiles from the ground in a hands free manner. Thus, unlike the related art, the present invention is well suited for one handed operation.
4. Means of quickly recovering and resetting the release cord. A guide assembly with a guide hole attaches to a section of the web handle to prevent the release cord from leaving the immediate reach of the user.
5. Means of self centering the basket to the web handle. The use of a loop structure on the base member of the basket and loop structure in the web handle allow for the use of a circular, one piece retention cord to attach the basket to the web handle.

Through arduous trial and error and from taking a unique approach in critical thinking, the present invention has been created to overcome shortfalls in the related art by presenting an unobvious configuration of cords, webbing, strapping, retention assembly, stopper, tab, basket and basket attachment points that result in surprising and unexpected results in sling performance.

The novel design of the basket securely holds a ball or other payload while the user creates a swinging motion with the sling. During circular rotation of the sling, the user may free the release tab. During the release process the ball will to start expelling itself out of the basket, while in motion, the basket will tilt outwardly, assisting in the proper release of the ball. As the ball exits the basket, the ball comes in contact with the release cord. The release cord is then pushed out of the way by the ejecting ball until the release tab is caught by the guide assembly. After fully expelling the ball, the user may easily locate the release cord and tab and reset the sling for the next ball or projectile. Due to the unique configuration of the basket and related basket attachment points, the next projectile may be scooped off of the ground without direct handling by the user.

The attachment location of the guide assembly upon certain areas of the web handle adds unexpected benefits in preventing the release cord from interfering with the release process of the ball leaving the basket. An improper attachment point of the guide assembly results in the projectile becoming trapped into the basket by the release cord.

Unexpected results in distance, power and accuracy are obtained by the use of cord material for the lower half of the retention structure and from the use of webbing for the upper web handle. Although slinging can be achieved by the use of either strapping or cord material, the principles of the present invention present the benefits of both. The use of strapping material alone to create a sling will not provide the power and momentum that is required to create distance in throwing a projectile. That is overcome by the use of cord material in the lower half that dramatically reduces air resistance. Having two cords in parallel provides the added benefits of stabilizing and balancing the basket/pouch.

Creating a basket that can securely hold a payload and be able to successfully launch a ball shaped projectile is not a trivial endeavor. The user's ability to accurately throw a ball is highly dependent upon the design of the basket. Creating a basket that will snuggly secure a ball will have the drawback of obstructing the projectile's natural projected course of direction during release. Hence, wanting to securely hold the ball into a basket causes the released projectile to be redirected away from the user's intended direction. This shortfall of the related art is overcome by the principles of the present invention by the unique attachment points of the retention cords to the lower half section of the basket, that greatly assists in allowing the basket to gracefully unfold during the release process, dramatically minimizing and nearly eliminating redirection of the projecting ball.

Unexpected results came with the advent of the basket's base portion component. As means of providing critical connection points the basket's base portion also added to the basket's structure strength, reinforcing the entire basket assembly. Unexpected results in increased projecting power where also achieved with the base portion, which localizes inertia force from the sling to the projectile. The base portion of the basket also changes the support function of the basket walls by unloading pressure off the walls and increases the overall durability of the basket assembly.

Loading a projectile into the basket without the assistance from the user's hands was stumbled upon through testing and playing with prototypes. The method quickly became preferred and further alterations were made to incorporate this idea. The shape and design of the templates that create the sides of the basket had to integrate the right length, height, angle and cut, to consist U or V shaped edges. These U or V edges give the basket the ability to easily load a ball without the need of the user's hands by either scooping or rolling the ball into the basket/pouch.

VARIOUS OBJECTS OF THE INVENTION

Numerous objects or goals of the invention are discussed below. The listing below is not comprehensive and does not limit any aspect, function, or feature of the principles of the invention. This disclosure is limited only by the limitations of the claims.

One aspect of the invention is to provide an apparatus for throwing, tossing, slinging, hurling a ball or spherical shaped projectile. It is the object of the current invention to provide a device and method for one to play fetch games with an animal or dog. The principles of the invention may be used to provide a device and method for one to play catch or other recreational games.

It is yet another object of the current invention to provide a sling that is easy and fun to use for one with little to no experience in slinging. The present invention overcomes shortfalls in the related art by reducing the hassles of setup and staging of a traditional sling.

It is also the object of the current invention to provide a device that one can easily load a ball or spherical shaped object hands free with or without little assistance from the user foot or toe. Eliminating the need for one to bend down, pickup and load ones projectile. An object of the current invention is to provide a device that is accurate and powerful enough for one to launch a ball or spherical shaped object at great distances.

It is further the object of the current invention to provide a device that is easily portable, convenient and lightweight for one to place in ones pack or pocket for practical transportation.

It is as well an object of the current invention to provide a device and method that one can throw balls or spherical shaped objects in different manners, whether using it to throw upper hand, lower hand, or sideways, the user has great control over the projectile whether it is lightly tossed a few feet or at great distances. An object of the current invention is to provide a device that is safe to use for both the user and bystanders, reducing the changes of accidental "whipping" and "slapping" of one's self or another that can be caused by traditional slings.

These and other objects from above provide a safe, fun, practical throwing sling. Overall setting the retention cords finger loop around the user's middle finger then pinching the release tab between the thumb and index finger, one can now easily scoop up or roll a ball into the slings basket/pouch without the assistance from the user's hand.

The invention is designed to throw a ball or spherical object that would be easy enough for someone with little to no experience to operate. A goal was to reduce the complications and hassles of a standard sling allowing one in the general public to be able to enjoy slinging. This invention was developed to provide a gift for the inventor's pet dog Mocha for her $7^{th}$ birthday.

REFERENCE NUMERALS IN THE DRAWINGS

Figure 1:
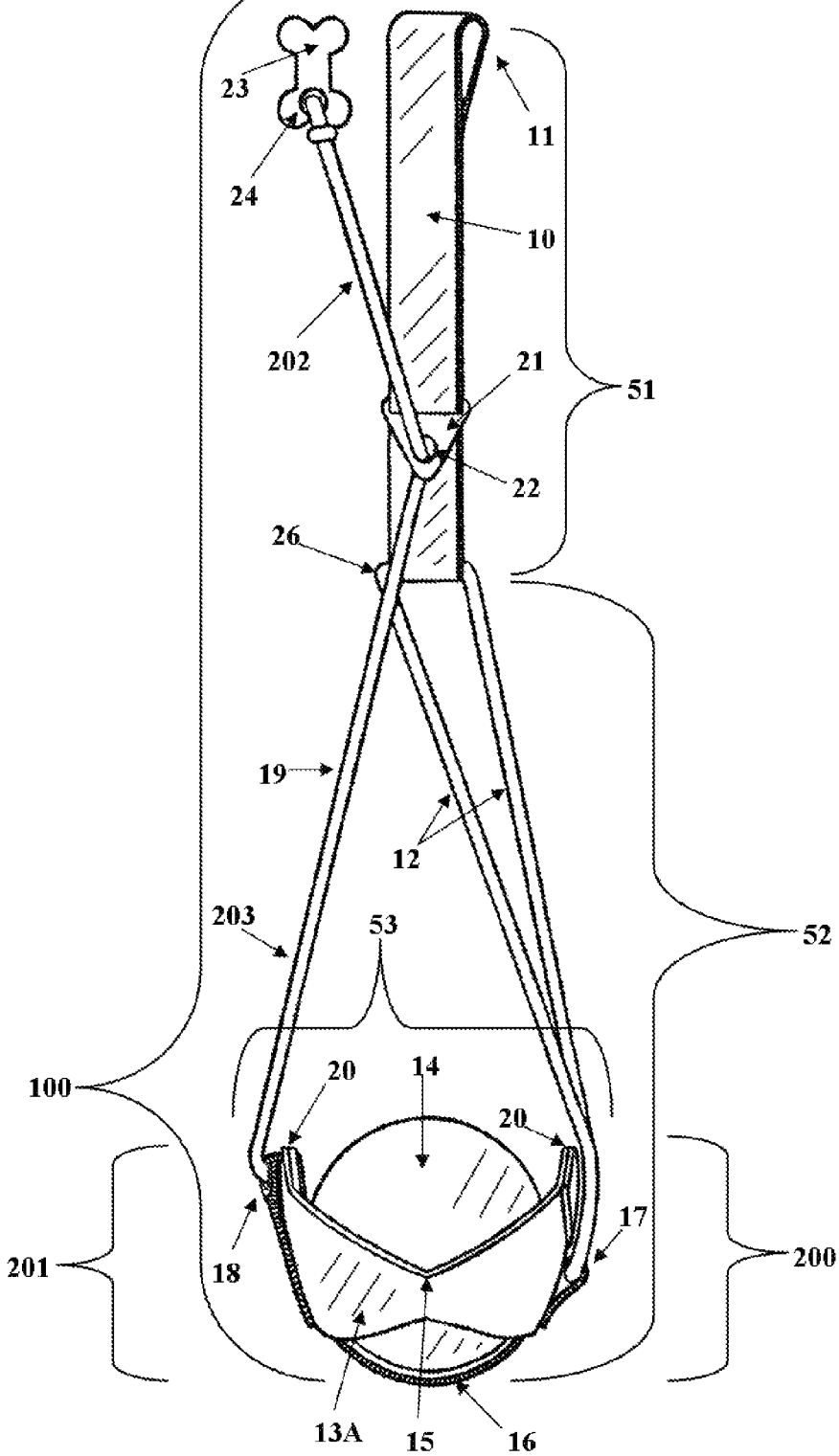
FIG. 1 is a perspective view of the overall sling constructed in accordance with the principles of the present invention.
Figure 2:
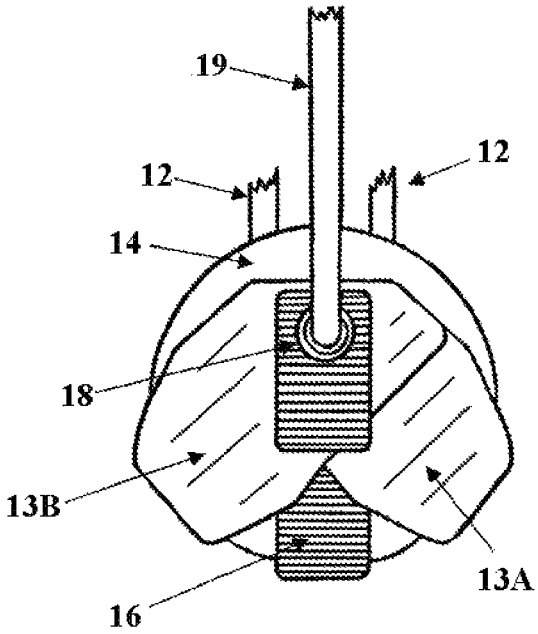
FIG. 2 is perspective view of a release side of a basket/pouch constructed in accordance with the principles of the present invention.
Figure 3:
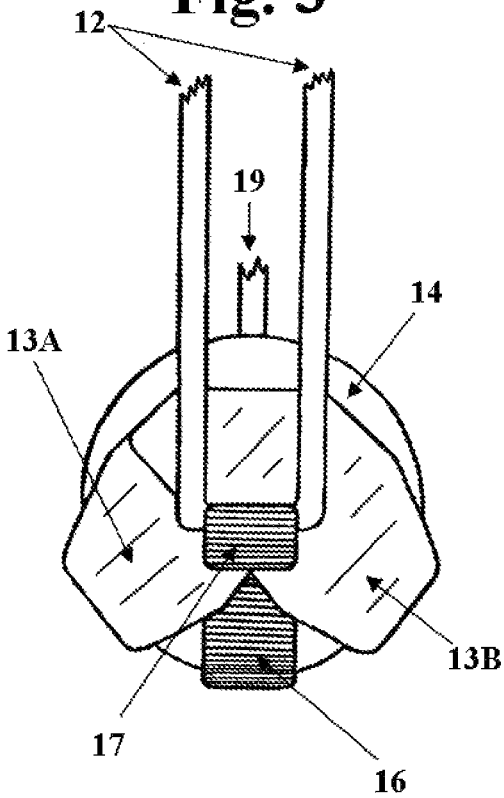
FIG. 3 is perspective view of a retention side of a basket/pouch constructed in accordance with the principles of the present invention.

10 web handle
11 finger loop located at top end of web handle 10
12 looped retention cord, may be made of cord or cord like material
13 A, B patterns of material or side basket components that when combined may form the sides of basket assembly 53
13 C, D templates used to create patterns of material for side basket components 13A and 13B
14 ball or spherical shaped projectile
15 V or U shaped edge design of side basket material 13A or 13B
16 base webbing member of basket, or basket base member, may be made of webbing or other similar material
17 connection loop of base webbing member of basket, used to connect with looped retention cord 12
18 connection point of release cord 19 to basket assembly 53
19 release cord
20 connection points of side basket components 13A and 13B
21 guide assembly for retaining release cord 19 to web handle 10
22 guide hole contained within guide assembly 21, used to retain release cord 19 to upper handle 10
23 release tab found at the top end of release cord 19
24 connection point or connection void used to connect release cord 19 and release tab 23
25 user's hand and fingers
26 web handle connection loop formed by the lower section of web handle 10, used to attach looped retention cord 12 to the web handle.
27 diamond shaped void at a bottom section of basket formed by 13A, 13B or 13C, 13D
51 upper retention assembly comprising, web handle 10, finger loop 11, guide assembly 21, guide hole 22 and web handle connection loop 26.
52 lower retention assembly comprising looped retention cord 12 (connected through the web handle connection loop 26), connection loop of base member of basket 17, and base member of basket 16.
53 basket assembly or basket, comprising side components 13A, 13B, base webbing member of basket 16, connection loop 17, and connection point 18 to release cord.
100 entire sling assembly, as shown in FIG. 1
200 retention side of basket assembly 53
201 release side of basket assembly 53
202 upper end of release cord 19
203 lower end of release cord 19

DETAILED DESCRIPTION OF THE PREFERRED EMBODIMENTS

In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

The reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment nor are separate alternative embodiments mutually exclusive of other embodiments.

In the following detailed description of embodiments of the invention, reference is made to the accompanying drawings in which like references indicate similar elements, and in which is shown by way of illustration specific embodiments in which the invention may be practiced. These embodiments are described in sufficient detail to enable those skilled in the art to practice the invention, and it is to be understood that other embodiments may be utilized and that logical, mechanical, electrical, functional, and other changes may be made without departing from the scope of the present invention. The following detailed description is, therefore, not to be taken in a limiting sense.

The description, which follows, and the embodiments described herein, are provided by way of illustration of an example, or examples of particular embodiments of the principles of the present invention. These examples are provided for the purposes of explanation, and not of limitation, of those principles of the invention. In the description, which follows, like parts are marked throughout the specification and the drawings with the same respective reference numerals. The drawings are not necessarily to scale and in some instances proportions may have been exaggerated in order to more clearly depict certain features of the invention.

Referring to FIG. 1, web handle 10 may be constructed of webbing, nylon strap or other similar material. At the top of web handle 10, webbing may be looped to create that create finger loop 11 for the user to easily hold and secure the sling as shown generally in FIG. 4. The wider strapping of finger loop 11 gives the user more feel of control over the sling itself. Thus also the use of strapping type material or webbing in web handle 10 reduces twisting of the entire sling assembly.

Referring to FIG. 1, looped retention cord 12 was designed to dramatically reduce air resistance caused by the user's swinging momentum. Looped retention cord 12 may comprise one or more connected or looped non elastic rope/cable/Para-cord/nylon cords. Connecting the cords comprising looped retention cord 12 results in a self aligning and self balancing of looped retention cord 12 to connection loop of base member of basket 17 and web handle connection loop 26. Looped retention cord 12 may slide within connection loop of base member of basket 17 and web handle connection loops 26 to form parallel cords that assist in stabilizing and balancing the basket assembly 53. The width of web handle 10 and integrated connection loop 17 spread the cords of looped retention cords 12 prevent the entire sling assembly 100 from twisting. In an alternative embodiment, looped retention cord 12 is fixed within connection loop of base member of basket 17 and web handle connection loop 26.

Figure 6:
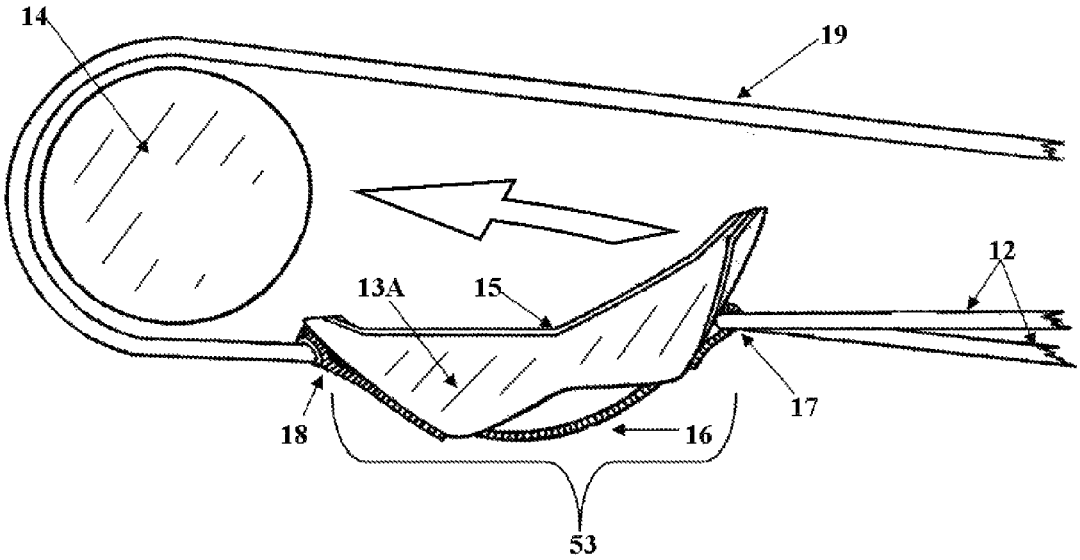
FIG. 6 is a prospective view of a ball being released from a sling constructed in accordance with the principles of the invention.
Figure 7:
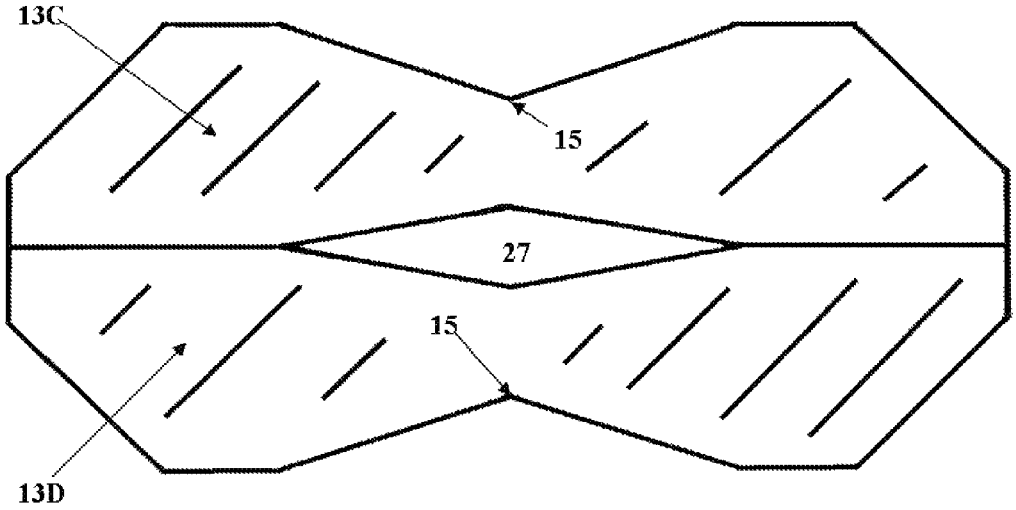
FIG. 7 is a plan view of a template for the use of constructing the basket/pouch in accordance with the principles of the present invention.

Referring to FIG. 7, side basket components 13A and 13B may be created by using two separate templates 13C, 13D of polyester/nylon/leather/rubber or other similar material. Templates 13C, 13D when combined together at connection points 20 form side basket components 13A and 13B, which in turn are designed to securely hold a spherical object 14 roughly 2.5 inch in diameter or smaller. Side basket components 13A and 13B may be constructed out of two templates FIG. 7, 13C, 13D or of similar material or may be constructed out of a single mold. Side basket components 13A and 13B may have scooped shaped edges 15 consisting of a U or V as shown in FIG. 6. Top edges 15 allow for easy hands free loading of a projectile 14 with little to no assistance from the user's feet or toe thus allowing the method of rolling or scooping action of the projectile 14 into the basket assembly 53. The edge design of side basket material 13A and 13B eliminates the need for a user to bend down to pick up a desired projectile 14 with their hands to place it into the basket assembly 53. The unique shape and design the basket templates 13A, 13B also prevents the resulting basket from turning or flipping inside out, a common problem in the related art.

In addition to basket side portions 13A, 13B basket assembly 53 also comprises a base member of basket, or basket base member 16. Basket base section 16 runs under basket side sections 13A, 13B and may be constructed from nylon/polyester strapping or webbing similar to web handle 10. One purpose of basket base member 16 is to reinforce basket side sections 13A, 13B and add strength and durability, distributing the momentum force of the projectile to the bottom of the basket assembly 53. The basket formed by basket side portions 13A, 13B helps guide a projectile through the release process for increased accuracy.

Another purpose of base member of basket 16 is to form two connection points 17, 18 upon the basket assembly. On the retention side, basket base member 16 may form connection loop 17 used to connect with looped retention cord 12; on the release side, basket base member 16 may form connection point 18, used to secure release cord 19 to basket assembly 53.

The use of a basket base member 16 allows for unique connection points upon the basket assembly that result in unexpected and unforeseen improvements in sling performance to the overall sling assembly 100. For example, the retention side connection point 17 of the basket assembly 53

This allows the connection point 17 of the retention cords 12 to be specifically located at a point or range of points approximately ½ the distance between the bottom portion of the basket and top portion of the basket. On the release side of the basket, base member 16 integrates into connection point 18 located at the top side of the basket, to form an unobvious combination of a high release connection point 18 and a low retention connection point 17 that results in unexpected results shown in FIG. 6 of the basket assembly 53, opening outwardly to assist in expelling the projectile 14 from the basket. The two asymmetrical connection points of the basket assembly 53 allow the sling to have uncanny accuracy over the related art and helps to ensure the full release of a projectile 14 from the basket.

Figure 4:
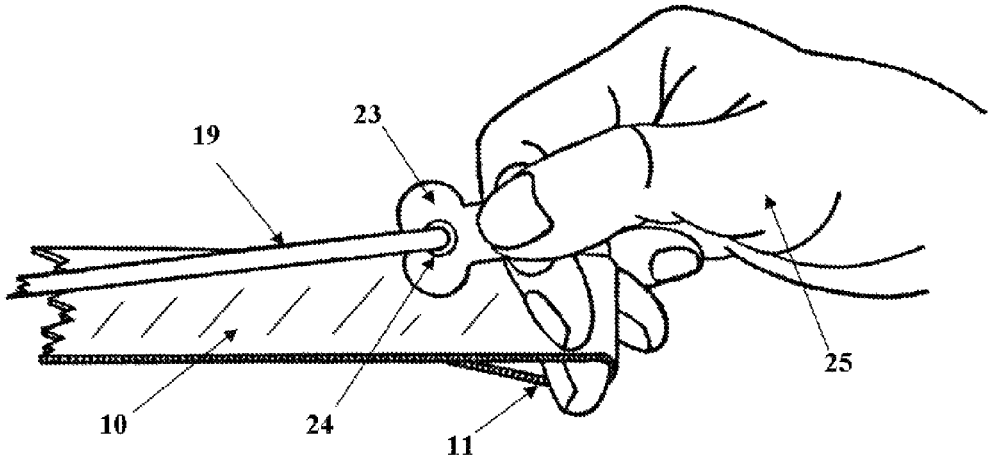
FIG. 4 is a perspective view of a user holding the upper end of a sling constructed in accordance with the principles of the present invention.
Figure 5:
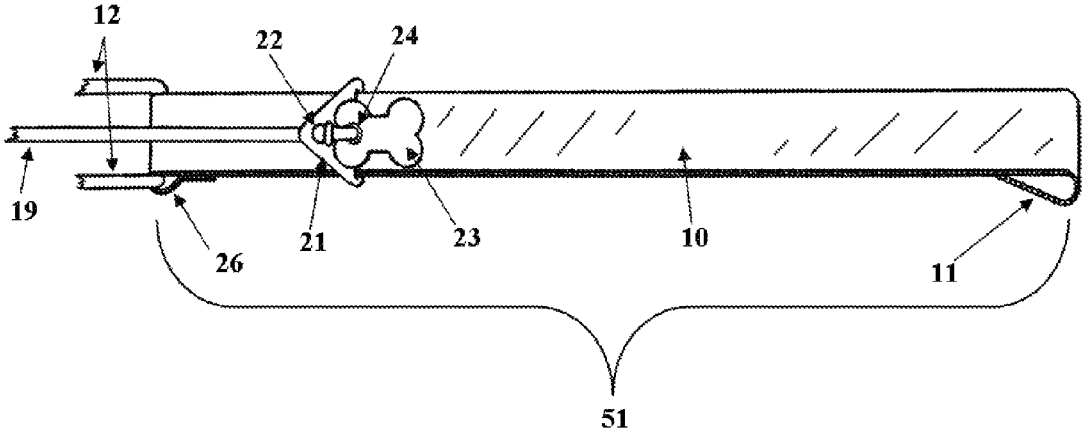
FIG. 5 is a perspective view of release tab being stopped by a guide assembly.

Another unique and subtle feature is the guide assembly 21 used for retaining release cord 19 to web handle 10. Guide assembly 21 is connected onto the lower portion of web handle 10. Guide assembly 21 comprises a guide hole 22, used for containing release cord 19. Guide hole 22 is of sufficient diameter as to allow for passage of release cord 19, but yet, is of small enough diameter to stop release tab 23 from passing through the guide assembly, as shown in FIG. 5. Release tab 23 is found at the top end of release cord 19. FIG. 4 shows a user's hand securing a release tab 23 and finger loop 11. Release cord 19 is secured to release tab 23 by insertion through void 24 contained within release tab 23.

The disclosed location of the guide assembly 21 upon the web handle 10 allows enough movement of release cord 19 to allow a projectile 14 to fully exit the basket assembly 53 before the guide assembly 21 and release tab 23 become engaged. The disclosed combination of using a guide assembly 21, guide hole 22, and enlarged release tab 23 fastened to a release cord 19 provides the unexpected pleasure of avoiding the hassle of recovering the end the release cord 19. In the related art, release cords fly encumbered and are difficult to recover. The disclosed release cord retention system allows for faster speed and easier effort to reset and prepare for the loading of the next projectile. Also, this combination helps reduce the tangling of cords of the general sling assembly 100.

Referring to FIG. 1, release cord 19 may be constructed out of non elastic rope/cable/Para-cord/nylon or similar material and connects to the upper connection point 18 of the basket member base 16. Release cord 19 then is fed through guide hole 22 found within guide assembly 21 and then inserted through the connection void 24 found within release tab 23. This disclosed configuration also reduces the chances of the projectile 14 snagging the release cord 19 and eliminates the chance of the release cord 19 trapping the projectile 14 into the basked assembly 53.

Release tab 23 may function as a stopper that is connected to the end of the release cord 19. The release tab 23, may be constructed from polyester/nylon/leather/rubber or similar material that provides a comfortable flat surface that is placed between the thumb and index finger as shown in FIG. 4.

Certain principles of the invention may also be described by the following items:

1. A ball throwing sling, comprising:

a) a retention structure comprising an upper and lower assembly:

i. an upper retention structure assembly 51 comprising a web handle 10, finger loop 11 at the top of the web handle 10, a guide assembly 21 attached to the web handle 10, a guide hole 22 contained within the guide assembly 21, and a web handle connection loop 26 made from the lower section of the web handle 10;

ii. a lower retention structure assembly 52 comprising a looped retention cord 12 connected to the upper retention structure assembly 51 through the web handle connection loop 26, and connected to a basket assembly 53 by insertion through a connection loop 17 formed by a base webbing member 16 of a basket assembly 53;

b) a basket assembly 53 comprising three parts:

i. first and second parts comprising two side basket components 13 A, 13 B attached together to create sides of a basket assembly 53 and to create upper and lower side portions 15, shaped in a V or U shape; the resulting basket sides having a retention side 200 and a release side 201; and the resulting basket sides having means to accept a ball;

ii. a third part comprising a base webbing member of basket 16 forming a bottom section of the basket assembly 53 and forming a connection loop 17 on the retention side 200 of the basket, used to accept the looped retention cord 12, and creating a connection point 18 on the release side 201 of the basket to accept a release cord 19;

c) a release cord 19 comprising:

i. upper end 202 attached to a release tab 23 by use of a void 24 within the release tab 23, the upper end of the release cord 19 run through the guide hole 22 contained within the guide assembly 21; and ii. a lower end 203 attached to the release side 201 of the basket through the connection point 18 formed by the base webbing member of basket 16.

2. The sling of item 1 wherein the retention side 200 of the basket 53 has a connection loop 17 formed by the base webbing member 16 of the basket such that the connection loop 17 is located at a point approximately half way between the lower most section of the base webbing member 15 and upper most section of the side basket components 13A, 13B.
3. The sling of item 1 wherein the release side 201 of the basket 53 has a connection point 18 for release cord 19 such that the connection point 18 is located at a point approximately at the upper most section of the basket assembly 53.
4. The sling of item 1 wherein the upper retention assembly 51 is between 15 and 18 inches in length and the lower retention assembly 52 is between 13 and 16 inches in length.
5. The sling of item 1 wherein the upper retention assembly 51 is approximately the same length as the lower retention assembly 52.
6. The sling of item 1 wherein the guide assembly 21 for retaining release cord 19 to web handle 10 is located at an approximate point within the lower ¼ to ⅓ of the length of the web handle 10.
7. The sling of item 1 wherein the guide assembly 21 for retaining release cord 19 to web handle 10 is located at an approximate point of one to three inches from the bottom of the web handle 10.
8. The sling of item 1 wherein the looped retention cord 12 is fixed within and non rotating within connection loop 17 of the base webbing member the basket and web handle connection loop 26 formed by the lower section of the web handle.
9. A method of throwing a ball using the sling of item 1, the method comprising:
   a) setting finger loop 11 of the web handle 10 around the user's middle finger then pinching the release tab 23 between the thumb and index finger, FIG. 4
   b) scooping up or rolling a ball into the slings V or U shaped 15 basket 53 without the assistance from the user's hand;
   c) using the basket 53 to securely hold the ball 14 while the user creates a circular swinging motion of the sling;
   d) at a moment of forward momentum of the object to be launched, the user releases the release tab 23, causing the ball 14 to start expelling itself out of the basket 53;
   e) while in motion the basket 53 will tilt outwardly to assist in the proper release of the ball, FIG. 6;
   f) as the ball 14 exits the basket 53 it comes in contact with the release cord 19, the release cord 19 is then pushed out of the way by the ejecting ball until the release cord is caught by the release tab 23 at the guide assembly 21; and
   g) after fully expelling the ball the user then locates the release tab 23 that is trapped on the guide assembly 21 and then resets the sling for the next ball or projectile.
10. The method of item 8 wherein the looped retention cord 12 is allowed to rotate within the web handle connection loop 26 of the web handle 10 and is allowed to rotate within the connection loop 17 of the base webbing member 16, the connection loop being located on the retention side 200 of the basket.
11. The method of item 9 wherein the rotation of the looped retention cord 12 is used with the release cord 19 to assist in stabilizing and balancing the basket and keeping the basket from overturning or flipping.
12. A basket 53 for use with a sling, the basket 53 comprising:
   a) two side components 13A, 13B or 13C 13D having upper and lower midsections 15 formed in the shape of a V or U, with the V or U shape providing means of scooping a ball, with the side components made of a soft flexible material and having a diamond shaped void 27 at a bottom section of the basket and with the side components being attached together at points 20 found at the upper most sections of the basket; and
   b) a base webbing member 16 attached to the basket, the base webbing member forming a loop 17 at the lower midsection of the basket on a retention side of the basket 200 and the base webbing member 16 forming a connection point 18 at the upper most section found on a release side 201 of the basket.
13. The basket 53 of item 12, further comprising a looped retention cord 12 secured within the loop 17 at the lower midsection of the basket on a retention side of the basket 200.
14. The basket 53 of item 12 further comprising a release cord 19 attached at the connection point 18 formed by the base webbing member 16 at the upper most section found on the release side 201 of the basket.
15. The basket 53 of item 12 further comprising a web handle 10 attached to the looped retention record 12 by a web handle connection loop 26 formed by the lower section of the web handle 10.
16. The basket 53 of item 12 further comprising a guide assembly 21 attached to the web handle 10 with the guide assembly having a void 22 suitable for accepting the release cord 19 and with the release cord 19 inserted through the void 22 of the guide assembly 21.
17. The basket of 53 of item 12 further comprising upper and lower midsections 15 formed in the shape of a V or U, with the V or U shape providing means of scooping a ball.

What is claimed is:

1. A sling, comprising:

a) an upper retention structure assembly and a lower retention structure assembly:
   i. an upper retention structure assembly comprising a web handle, finger loop at the top of the web handle, a guide assembly attached to the web handle, a guide hole contained within the guide assembly, and a web handle connection loop made from the lower section of the web handle;
   ii. a lower retention structure assembly comprising a looped retention cord connected to the upper retention structure assembly through the web handle connection loop and connected to a basket assembly by insertion through a connection loop formed by a base webbing member of the basket assembly;

b) a basket assembly comprising three parts:
   i. first and second parts comprising two side basket components attached together to create sides of a basket assembly and to create upper and lower side portions shaped in a V or U shape; the resulting basket sides having a retention side and a release side; and the resulting basket sides having means to accept a ball;
   ii. a third part comprising a base webbing member of the basket assembly, the base webbing member forming a bottom section of the basket assembly and forming a connection loop on the retention side of the basket assembly, used to accept the looped retention cord, and creating a connection point on the release side of the basket to accept a release cord;

c) a release cord comprising:

i. an upper end attached to a release tab by use of a void within the release tab, the upper end of the release cord running through a void contained within the guide assembly; and ii. a lower end attached to the release side of the basket assembly through a connection point formed by the base webbing member of the basket assembly.

2. The sling of claim 1 wherein the retention side of the basket assembly has a connection loop formed by the base webbing member of the basket assembly such that the connection loop is located at a point approximately half way between the lower most section of the base webbing member and upper most section of the side basket components.

3. The sling of claim 1 wherein the release side of the basket assembly has a connection point for the release cord such that a connection point is located at a point approximately at the upper most section of the basket assembly.

4. The sling of claim 1 wherein the upper retention assembly is between 15 and 18 inches in length and the lower retention assembly is between 13 and 16 inches in length.

5. The sling of claim 1 wherein the upper retention assembly is approximately the same length as the lower retention assembly.

6. The sling of claim 1 wherein the guide assembly for securing the release cord to the web handle is located at an approximate point within the lower ¼ to ⅓ of the length of the web handle.

7. The sling of claim 1 wherein the guide assembly for securing the release cord to the web handle is located at an approximate point of one to three inches from the bottom of the web handle.

8. The sling of claim 1 wherein the looped retention cord is fixed within and non rotating within the connection loop of the base webbing member the basket and the web handle connection loop formed by the lower section of the web handle.

* * * * *